United States Patent [19]

Kemp

[11] Patent Number: 4,678,693

[45] Date of Patent: Jul. 7, 1987

[54] INSULATING FABRIC AND METHOD OF MANUFACTURE THEREOF

[75] Inventor: Philip Kemp, Closter, N.J.

[73] Assignee: J. E. Morgan Knitting Mills, Inc., Tamaqua, Pa.

[21] Appl. No.: 823,674

[22] Filed: Jan. 29, 1986

[51] Int. Cl.[4] ..... B32B 33/00

[52] U.S. Cl. ..... 428/91; 26/29 R; 26/30; 428/253; 428/254

[58] Field of Search ..... 428/91, 253, 254; 26/29 R, 30

[56] References Cited

U.S. PATENT DOCUMENTS 4,199,633 4/1980 Blore ..... 428/91

*Primary Examiner*—Marion C. McCamish

*Attorney, Agent, or Firm*—Robert B. Frailey

[57] ABSTRACT

Insulating fabric having a knitted base fabric incorporating air-entrapping cells on one or both sides. The base fabric is knit from a high bulk acrylic yarn and a combination polyester and cotton yarn, the yarns being knitted separately in selected fabric courses. The inner face of the fabric is formed of the high bulk yarn, to provide a soft, warm and comfortable interior surface when worn. The outer face of the fabric is formed of the polyester/cotton yarn, which provids a knitted framework for anchoring and stabilizing the high bulk yarn in the fabric. Following knitting, the fabric is subjected to a series of finishing operations which include scouring, padding, drying, napping and calendering. As the result of repeated washings, the insulating fabric of the invention increases in thickness to enhance its heat insulating capability and provide increased warmth.

10 Claims, 7 Drawing Figures

| | C | D | C | D | C | D | C | D |
|---|---|---|---|---|---|---|---|---|
| 1 | T | K | W | K | T | K | W | K |
| 2 | K | T | K | W | K | T | K | W |
| 3 | T | K | W | K | T | K | W | K |
| 4 | K | T | K | W | K | T | K | W |
| 5 | T | K | W | K | T | K | W | K |
| 6 | K | T | K | W | K | T | K | W |
| 7 | T | K | W | K | T | K | W | K |
| 8 | K | T | K | W | K | T | K | W |
| 9 | W | K | T | K | W | K | T | K |
| 10 | K | W | K | T | K | W | K | T |
| 11 | W | K | T | K | W | K | T | K |
| 12 | K | W | K | T | K | W | K | T |
| 13 | W | K | T | K | W | K | T | K |
| 14 | K | W | K | T | K | W | K | T |
| 15 | W | K | T | K | W | K | T | K |
| 16 | K | W | K | T | K | W | K | T |

| | D | D | C | C | D | D | C | C |
|---|---|---|---|---|---|---|---|---|
| 1 | T | T | K | K | T | T | K | K |
| 2 | T | T | K | K | T | T | K | K |
| 3 | T | T | K | K | T | T | K | K |
| 4 | K | K | K | K | K | K | K | K |
| 5 | K | K | T | T | K | K | T | T |
| 6 | K | K | T | T | K | K | T | T |
| 7 | K | K | T | T | K | K | T | T |
| 8 | K | K | K | K | K | K | K | K |

FIG. 7

INSULATING FABRIC AND METHOD OF MANUFACTURE THEREOF

BACKGROUND OF THE INVENTION

This invention pertains to fabrics designed and intended primarily for use in winter weight underwear. However, since the fabrics of the invention have an insulating quality, their use is not limited to winter underwear garments. They have utility wherever fabric warmth is desired, for example, in the manufacture of sweaters, sportswear, blankets and the like.

From time immemorial it was conventional for winter underwear fabrics to be sold by weight, for the reason that, in general, the heavier the fabric the warmer the garments made from it. The reason for this is that textile fibers entrap air to a substantial degree, and it is the entrapped air which gives a fabric its insulating quality. Thus, the insulating or thermal effectiveness of a fabric used in making cold weather garments, such as winter underwear, is determined by the amount of air entrapped in the fabric. Accordingly, in the days of yore, winter wear fabrics were designed on the theory that the heavier the fabric by weight, the warmer it would be.

In more recent years, however, fabric designers have developed new fabrics constructed with air-entrapping cells or pockets on one or both sides which provide dead air spaces in the fabric. Such fabric structures trap more air than that entrapped by the fibers alone, and thus enhance the insulating quality of the fabric. Knitted fabrics constructed with a multitude of such air pockets or air-entrapping cells are known as "thermal" fabrics.

The air-entrapping cells in such fabrics are three dimensional cavities having spaced top, bottom and side walls and a floor, which trap and retain air warmed by the heat of the human body. The trapped air gives the fabric an enhanced heat insulating or heat retention quality, thus adding to its insulation, warmth or "thermal" quality.

The original thermal fabric, first known as "waffle knit" fabric, was developed by the United States Navy for military use in about 1951. The Navy's waffle knit fabric is a flat, warp knit fabric made on a double needle bar raschel knitting machine. It soon found acceptance for civilian use in underwear, and became known popularly as "thermal underwear". A brief history of the Navy's waffle knit raschel thermal fabric will be found in Professor William E. Schinn's article "The Philip Model PT/RR Machine" published in the April 1968 issue of "The Knitter" magazine, beginning at page 37.

A great interest soon arose in the underwear industry for developing a competing weft knit thermal fabric which could be made on conventional circular knitting machines. A weft knit thermal fabric eventually was developed, for which Morgan U.S. Pat. No. 2,839,909 was granted. The Morgan patented fabric is made on a multifeed circular rib knitting machine having dial and cylinder needles disposed in a 2×2 rib knitting arrangement. Its air-entrapping cells are produced by alternate triple tucking, first on one set of needles, then on the other set of needles, the non-tucking needles knitting plain stitches. The Morgan thermal fabric is characterized by spaced groups of tuck strands extending across the valleys formed between the ribs of the fabric, the ribs forming the side walls of the air-entrapping cells and the spaced tuck strands forming the top and bottom walls of the cells.

Later on, a second weft knit thermal fabric was developed utilizing the Philip Model PT/RR knitting machine, for which Philip U.S. Pat. No. 3,568,475 was granted. The PT/RR machine is a multifeed 1×1 circular rib knitting machine using the flexer principle to rack the dial needles. In knitting the Philip patented fabric, the machine is arranged for knitting a full cardigan fabric. Selective racking of the dial needles is utilized, whereby the needles assume a 2×2 rib relationship during knitting of the fabric. Because the air-entrapping cells in succeeding rows in the Philip thermal fabric are staggered, the fabric more nearly simulates the raschel thermal fabric in appearance than does the earlier Morgan thermal fabric.

Subsequently, a third weft knit thermal fabric was introduced by J. E. Morgan Knitting Mills, Inc. of Tamaqua, Pa. which simulates yet more closely in appearance the raschel knit thermal fabric. This fabric is known in the trade as "circular raschel" because of its close simulation to the raschel thermal fabric. It is composed of repetitive sequences of knit, tuck and welt stitches which produce multiple air-entrapping cells disposed in staggered relationship on both sides of the fabric. The circular raschel thermal fabric also is knitted on a 1×1 circular rib knitting machine. Needle selection means are operative to select needles in alternating and repetitive sequences for knitting, tucking and welting in recurring cycles to produce a weft knit thermal fabric incorporating air-entrapping cells constructed of knitted stitches, tuck loops and floats.

For many years winter wear garments made from the raschel, Morgan, Philip and circular raschel thermal fabrics have been sold in the United States. The manufacture and sale of such thermal garments still is taking place.

In the knitting of fabrics generally, it is old practice to knit two or more yarns into a fabric in such a manner that one of the yarns appears on one face of the fabric and a different yarn appears on the opposite face of the fabric. In weft knitting, "plating" is a common practice in hosiery manufacture, wherein fabric is knitted of two yarns which may differ in color or other characteristic. The plated fabric is knit so that one yarn is visible on one side thereof and the other yarn is visible on the opposite side. Morancy U.S. Pat. No. 2,946,210 discloses a rib knit fabric formed of inelastic, elastic and stretch yarns and knitted so that the stretch yarn appears on the inner side of the fabric to provide a relatively soft texture, while the inelastic yarn is disposed on the outer face of the fabric to provide a relatively stiff and smooth texture.

SUMMARY OF THE INVENTION

The insulating fabric of this invention is characterized by a knitted base fabric of the thermal type having air-entrapping cells. The fabric preferably is knit from high bulk acrylic and combination polyester and cotton yarns fed to the knitting machine needles individually at selected yarn feeds. The inner face of the fabric is formed of the acrylic yarn. The outer face of the fabric is formed of the combined polyester and cotton yarn. The polyester/cotton yarn provides an exterior knitted framework for anchoring and stabilizing the high bulk acrylic yarn in the fabric. The inner fabric surface formed of the acrylic yarn provides a soft texture and a warm, comfortable feel or hand when the fabric is worn next to the skin, as in the case of thermal underwear.

The primary object of this invention is to provide a new and improved knitted insulating fabric for use in the manufacture of winter wearing apparel, such as underwear, which is warmer, lighter in weight, more comfortable in wear and more resistant to shrinking than knitted fabrics heretofore made and sold, and which is characterized by an ability, as the result of several machine washings, to increase both in thickness and warmth by at least 25%.

A further object of the invention is to provide a new and improved knitted insulating fabric having high bulk yarn knit in selected courses in the fabric, the high bulk yarn being disposed on one surface of the fabric and being anchored and stabilized therein by a knitted framework composed of a combined synthetic/cotton yarn.

A further object is to provide a new and improved insulating fabric having a base fabric constituted of knitted thermal fabric having air-entrapping cells, the fabric being knit of high bulk acrylic and blended polyester/cotton yarns disposed separately in selected courses, the fabric being characterized by stability, light weight with increased warmth, enhanced absorbency, increased resistance to shrinkage, enhanced comfort and an inherent capacity, upon repeated washings, to increase substantially in bulk, thickness and warmth.

A further object is to provide a method of knitting a new and improved insulating fabric which permits high bulk yarns, particularly high bulk acrylic yarn, to be knit successfully into the fabric and to be stabilized and retained therein during subsequent textile finishing operations, including napping, and during repeated wear and laundering.

Other objects and advantages of this invention will be readily apparent from the following description of preferred embodiments thereof, reference being had to the accompanying drawing.

DESCRIPTION OF THE VIEWS OF THE DRAWING

FIG. 7 is a second knitting diagram showing schematically the operation of the cylinder and dial needles in knitting an alternative weft knit thermal fabric utilized in the practice of this invention.

DETAILED DESCRIPTION OF THE INVENTION

Figures 1, 2:
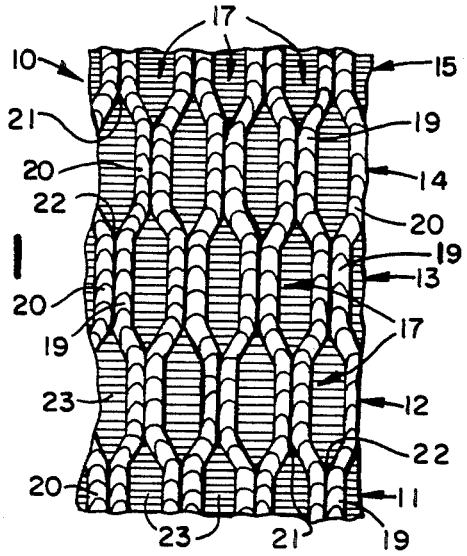
FIG. 1 is an enlarged, fragmentary view illustrating schematically a preferred weft knit thermal fabric utilized in the practice of this invention.
FIG. 2 is a knitting diagram showing schematically the operation of the cylinder and dial needles in knitting successive courses of the thermal fabric illustrated in FIG. 1 on a 1×1 circular rib knitting machine.

The insulating fabric of this invention may be incorporated into any known knitted thermal fabric having air-entrapping cells formed on one or both sides of the fabric. For more effective insulation, however, it is preferred that the air-entrapping cells be formed on both sides.

FIGS. 1–6 of the drawing depict the embodiment of the invention which utilizes as the base fabric the circular raschel type of thermal fabric having air-entrapping cells on both sides constructed of a combination of knitted stitches, tuck loops and floats concatenated in a selected sequence.

Referring first to FIG. 1, where a portion of a circular raschel thermal fabric 10 is shown schematically, there are illustrated successive course-wise extending rows 11, 12, 13, 14, 15 of plural air-entrapping cells 17. The cells 17 are defined by course-wise spaced side walls 19, 20 and wale-wise spaced top walls 21 and bottom walls 22. Each cell is provided with a floor 23 disposed intermediate the spaced side, top and bottom walls.

The base fabric 10 depicted in FIG. 1 is a 1×1 rib knitted fabric made on a multi-feed weft knitting machine having opposed needle banks. Preferably, the needles are independently mounted in each of the needle banks with capacity to be raised and lowered selectively to clear level, tuck level, welt level and cast-off level, utilizing well known and conventional needle selecting means, to produce rib knitted fabric incorporating the stitches, tuck loops and floats which form the air-entrapping cells 17 in the fabric.

A suitable knitting machine for producing the thermal fabric 10 depicted in FIG. 1 is the Albi ROFS 16 feed, coarse gauge, body size, circular rib knitting machine. The Albi machine is provided with a rotatable cylinder and dial, each incorporating a plurality of independent needles alternating in a 1×1 arrangement. Positive yarn feeding means are utilized, such as furnishing wheels, to feed yarn to the needles at each of the yarn feeds at a selected rate of feed. A 10 cut machine is preferred, having a needle cylinder diameter within the range of 12″ to 17″ for knitting body size tubular fabric. The machine preferably is operated to knit a 16 feed, 8 repeat stitching cycle, shifting the knitting pattern after 4 repeats to provide the in-and-out effect necessary to form the air-entrapping cells 17 in staggered relation throughout the fabric. To ensure a tight knit fabric, the yarn is fed to the needles under a relatively heavy tension, as is usual in knitting thermal fabrics.

FIG. 2 illustrates the preferred method for knitting the thermal fabric 10 on a 16 feed circular rib knitting machine. The vertical columns denoted C and D refer to individual needles mounted on the cylinder and on the dial, respectively. The horizontal rows numbered 1, 2, 3, etc. to 16 identify consecutive yarn feeds spaced at uniform intervals around the needle cylinder of the machine. The letters T, K and W indicate, respectively, whether the cylinder and dial needles tuck, knit or welt during the knitting process.

The knitting diagram constituting FIG. 2 of the drawing depicts the stitch structure of the fabric 10 as well as the method of knitting that fabric. In illustrating the fabric, the horizontal row of letters C, D, C, etc. depicts, in alternation, the cylinder needle wales and the dial needle wales of the fabric. The vertical left-hand column of numbers 1, 2, 3, etc. indicates the courses of the fabric. The letter K identifies a knitted stitch, and the letter T indicates a tuck loop. The letter W indicates where a float is formed in the fabric when a needle is retained at welt level.

FIG. 2 depicts one complete knitting cycle of the base fabric 10 constituted of 16 yarn feeds/courses which produce, in the fabric, two successive course-wise extending rows 11–15 of air-entrapping cells 17, the cells of adjacent rows being staggered relative to each other.

As the knitting diagram of FIG. 2 illustrates, during knitting of the first 8 courses of a fabric cycle, all of the dial needles produce knitted stitches at the alternate yarn feeds 1, 3, 5 and 7. At those feeds the alternate cylinder needles are lowered to welt level to produce floats in the fabric, while the intervening cylinder needles are tucked to produce tuck loops. Meanwhile, at the intervening yarn feeds 2, 4, 6 and 8 the cylinder needles produce knitted stitches, alternate dial needles produce tuck loops and the intervening dial needles are welted to produce yarn floats.

During the knitting of the second 8 courses of the fabric cycle, at yarn feeds 9 to 16 inclusive, the knitting sequence is shifted to provide the in-and-out effect which creates the staggered air-entrapping cells 17 in successive rows 11–15 of the fabric 10. At the alternate yarn feeds 9, 11, 13 and 15, all dial needles continue to produce knitted stitches, but the cylinder needles are operated in reverse sequence. Alternate cylinder needles are tucked to produce tuck loops, while the intervening cylinder needles are welted to produce yarn floats. At the intervening yarn feeds 10, 12, 14 and 16, the cylinder needles continue to form knitted stitches, but the dial needles operate in reverse sequence, with the alternate dial needles welting to produce yarn floats and the intervening dial needles producing tuck loops.

The cycle of knitting depicted in FIG. 2 is repeated successively during the knitting of the fabric 10 to provide a fabric incorporating on each side a plurality of course-wise extending rows of air-entrapping cells 17, exemplified by rows 11–15, with the individual cells 17 of each row staggered relative to the cells of its adjacent rows.

In knitting the insulating fabric depicted in FIGS. 1–6, high bulk 100% acrylic yarn is fed to the needles at the alternate yarn feeds 1, 3, 5, 7, 9, 11, 13, 15 while a blended polyester and cotton yarn is fed to the needles at the intervening yarn feeds 2, 4, 6, 8, 10, 12, 14, 16. As a result, the acrylic yarn appears on the inside face of the fabric and the combined polyester and cotton yarn appears on the outside face of the fabric.

Because of its low moisture absorbency, ability to dry quickly, warmth characteristics, high bulk to weight ratio and soft, pleasant and resilient hand, the desirability of using high bulk acrylic yarn for knitting winter weight underwear long has been recognized. But high bulk acrylic yarn does not readily lend itself to the satisfactory knitting of fabrics. Because of the bulked character of such yarn, the resulting fabric is unstable, and is subject to ballooning, particularly width-wise, as a result of repeated launderings. Even during the knitting process, while still on the machine, the newly knitted fabric tends to balloon. For that reason, high bulk acrylic yarn has not been found to be satisfactory for knitting underwear fabrics.

Ths invention provides a solution to the instability problem inherent in the knitting of high bulk acrylic yarn. Knitting such yarn in combination with a blended polyester and cotton yarn introduces into the fabric the stability necessary to enable the knitting of commercially acceptable underwear fabrics from high bulk acrylic yarn. The problem of the ballooning of the fabric, both during the knitting process and as the result of subsequent laundering, is eliminated. And the finished fabric incorporates sufficient rigidity to maintain fabric stability during all of the post-knitting processes, such as scouring, drying, calendering, cutting and sewing, and during subsequent garment wear and laundering. In the finished fabric, the polyester/cotton yarn, which appears on the outside of the fabric, provides a relatively rigid knitted framework for anchoring and stabilizing the high bulk acrylic yarn which forms the inner face of the fabric.

A highly satisfactory insulating fabric may be constructed in the manner described above from DuPont's 22/1 (worsted count) Orlon 44 high bulk acrylic yarn and Eastman's 12/1 Kodel 50/50 polyester/cotton yarn. When the fabric is knitted of such yarns on a 10 gauge machine at a density of 15 stitches per inch off of the machine, the resulting fabric weighs approximately 7 ounces per square yard.

For a 10 gauge knitting machine, highly satisfactory insulating fabric will result from the use of the yarns within the following ranges:

high bulk acrylic—22/1–28/1 (worsted count)

50/50 polyester/cotton—10/1–18/1.

The combination of high bulk acrylic and blended polyester/cotton yarns is particularly advantageous in imparting improved shrinkage resistance to the new fabric. Whereas fabrics knit of high bulk acrylic yarn tend to balloon out, particularly width-wise, as the result of repeated launderings, fabrics knit of polyester/-cotton yarn tend to shrink width-wise as well as length-wise as a result of repeated launderings. In the insulating fabric of this invention, the inherent tendency of the high bulk acrylic yarn to balloon as the result of repeated launderings neutralizes the tendency of the poly/cotton yarn to shrink, with the result the fabric of this invention has virtually no width-wise shrinkage and has increased resistance to length-wise shrinkage. Thus, it is essential to knit a balanced fabric from the two quite disparate yarns. Careful consideration must be given to selecting acrylic and polyester/cotton yarns of compatible size in the knitting of the insulating fabric of this invention.

While it is preferred that the yarn forming the outside or knitted framework of the fabric be composed of a blend of 50% polyester and 50% cotton, some variation in that ratio is acceptable. However, 100% cotton yarn is not deemed to be satisfactory. It lacks sufficient stability to provide the requisite knitted frame for anchoring and stabilizing the high bulk acrylic yarn in the fabric. 100% polyester yarn also is unsatisfactory, notwithstanding its inherent stability. It is not sufficiently absorbent and its hand tends to be harsh.

Figure 3:
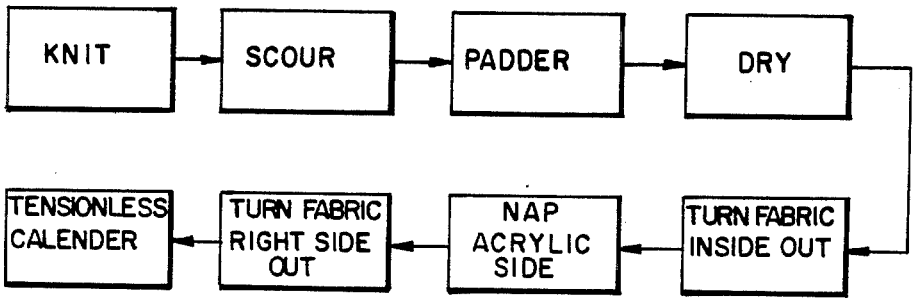
FIG. 3 is a schematic view of flow-sheet character illustrating the preferred sequence of manufacturing steps utilized in making an insulating fabric embodying this invention.

After the fabric has been knitted and removed from the knitting machine, it is subjected, while in tubular form, to a series of post-knitting finishing operations which are depicted schematically in FIG. 3. As illustrated by that Figure, the fabric is subjected to the following finishing operations:

(1) scouring—a conventional process whereby the fabric is subjected to an aqueous bath to remove dirt, oil, grease and other impurities;

(2) padding—following scouring, the fabric is processed in a padding machine, where the wet fabric tube is reopened, laterally extended, impregnated with a softener, padded and then laid up in folds;

(3) drying—following padding, the fabric is passed through a conventional textile dryer, where it is overfed as it is dried to improve fabric stability and control shrinkage, following which the fabric again is laid up in folds;

(4) napping—following drying, the tubular fabric is turned inside out to place its acrylic face on the outside of the fabric tube, following which the acrylic surface of the fabric is napped lightly twice in a conventional napping machine; following napping, the fabric is turned right side out to restore its napped acrylic face to the inside of the fabric tube;

(5) calendering—following napping, the fabric is finished by calendering on a conventional tensionless calender, where the fabric is uniformly stretched width-wise to the desired width and subjected to steam to relax the yarns and set the stitches, thereby imparting dimensional stability to the fabric.

Following calendering, the fabric is ready for cutting and sewing into garments.

As is well known, all thermal fabrics knitted of cotton yarn will, over the first several machine washings, increase in fabric thickness and in heat retention quality to some degree. These changes are due to shrinkage of the fabric during laundering, as a result of which the fabric structure becomes more compact, and the weight of the fabric increases slightly per square yard. After five or six machine washings, the fabrics tend to stabilize and manifest generally constant values of fabric thickness, heat retention and shrinkage. Eventually, after about ten launderings, such fabrics may begin to exhibit fiber loss, resulting in relatively minor decreases in fabric weight and sometimes, also, in fabric thickness.

Early mill tests of the insulating fabric of this invention, as depicted in FIGS. 1–6, revealed that the fabric achieved the following new, surprising and unexpected results:

1. As the fabric is laundered, up to about six machine washings, it increases significantly in warmth, up to 25% or more;

2. As the result of repeated machine washings, the fabric increases substantially in thickness, on the order of $33\frac{1}{3}$% or higher, thereby enhancing its ability to trap air; after about 10 washings, the increased thickness of the fabric tends to stabilize;

3. The napped inner face of the fabric does not become compressed or matted as the result of repeated washings, which would be normal; instead the acrylic inner surface increases in loft, adding bulk to the fabric;

4. Despite repeated laundering, the fabric retains its stability notwithstanding its large content of high bulk acrylic yarn;

5. The fabric has increased resistance to shrinkage, which is especially surprising in view of the large increase in fabric thickness after several machine washings;

6. The fabric, weighing approximately 7 ounces per square yard, is warmer than conventional thermal fabric knit of 100% cotton yarn and weighing approximately 9 ounces per square yard.

Figure 5:
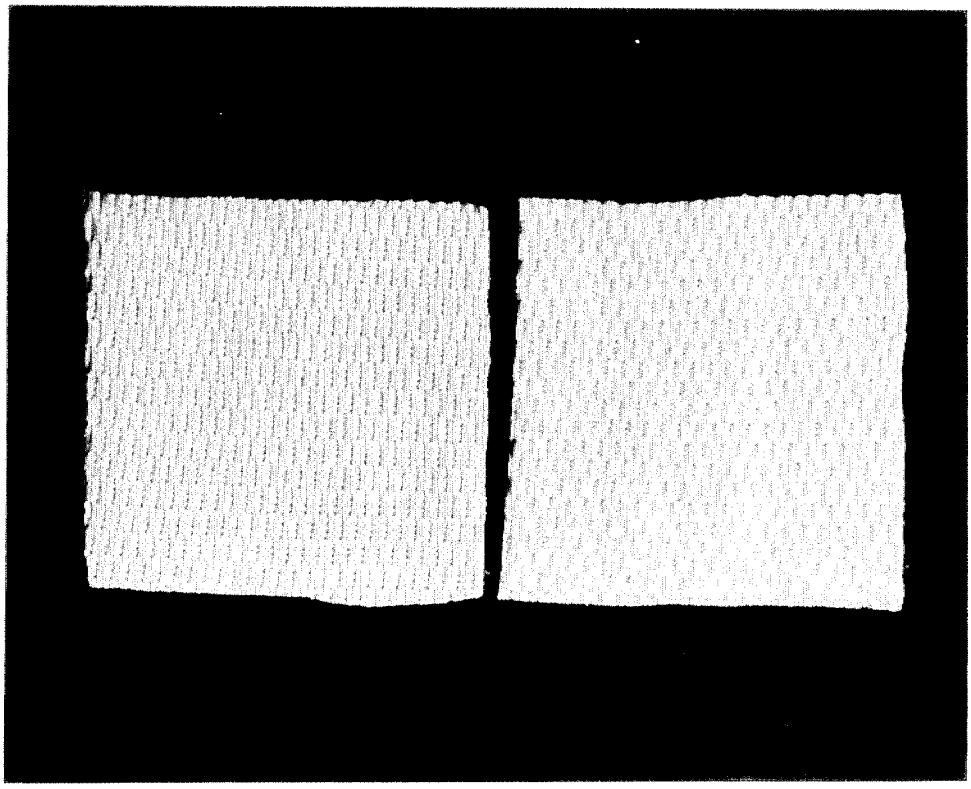
FIG. 5 is an unmagnified photograph showing the inner faces of two identical swatches of an insulating fabric incorporating this invention, the fabric on the left being unwashed and that on the right having been washed ten times.
Figure 6:
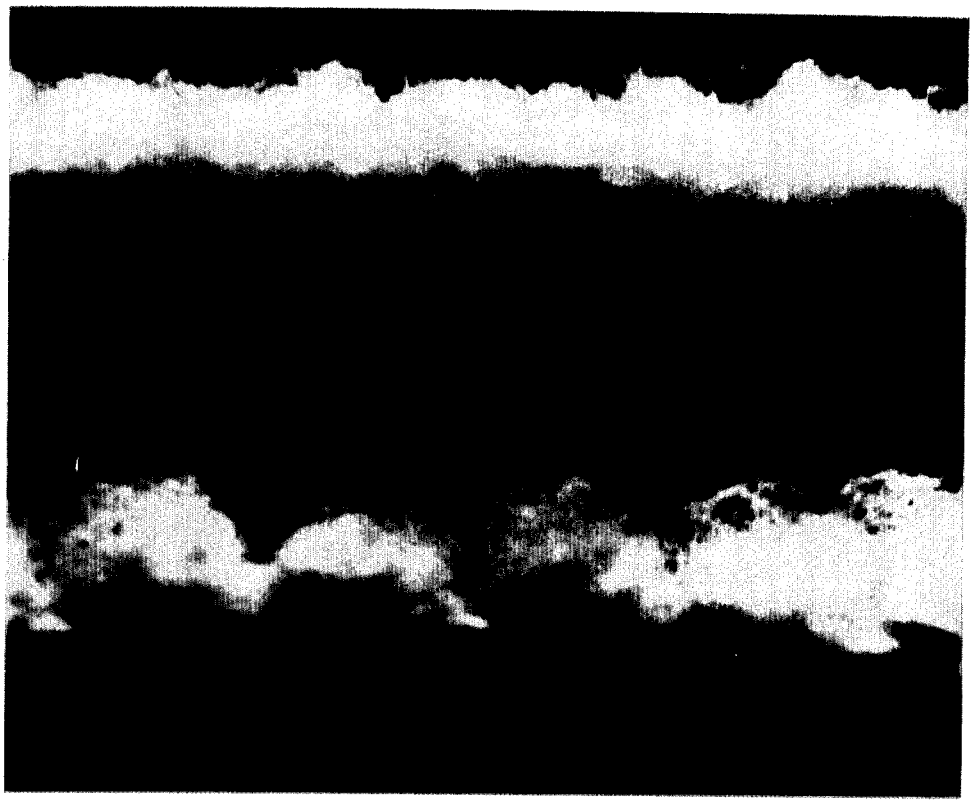
FIG. 6 is a photograph magnified thirty times, showing in side elevation the relative thickness of the two fabrics illustrated in FIG. 5, the upper fabric being the unwashed fabric and the lower fabric being the fabric which had been washed ten times.

The fabrics depicted photographically in FIGS. 5 and 6 of the drawing illustrate the physical changes which take place after the fabric has been subjected to 10 machine washings. FIG. 5 shows the inner acrylic face of two swatches of fabric knit and finished in accordance with FIGS. 1–3 of the drawing. The fabric on the left-hand side of FIG. 5 is unwashed, and that on the right-hand side has been washed 10 times. Comparison of the two fabrics reveals significant changes in the appearance of the inner acrylic surface of the washed fabric. The acrylic fibers have increased in loft or bulk, and the inner fabric face appears to be covered by a thin film of such fibers. Further, the air-entrapping cells have increased slightly in both width and depth, thereby increasing their air-entrapment capability.

The changes which have occurred in the washed fabric are illustrated even more dramatically in FIG. 6, where edge views of the two fabrics are illustrated. In FIG. 6, the upper fabric is the unwashed fabric and the lower fabric is the washed fabric. Comparison of the two fabrics, as depicted in FIG. 6, reveals that the thickness of the lower fabric, washed 10 times, is approximately 51% greater than the thickness of the upper, unwashed fabric.

During repeated machine washings, the napped acrylic surface of the fabric is continually combed out by the agitation of the washing machine, with the result that not only is its original loft maintained, rather than becoming matted, but the fibrous acrylic surface of the fabric actually increases in bulk. It is this phenomenon which enables the fabric, as the result of repeated machine washings, to enhance its ability to trap air, thus increasing its heat retention quality.

The results of the initial mill tests of the new fabric, described above, have been confirmed by independent laboratory tests conducted by Eastman Chemical Products, Inc. in Kingsport, Tenn. and by The Philadelphia College of Textiles & Science, in Philadelphia, Pa. Both laboratories conducted thermal transmittance tests of the new fabric in comparison with the triple tuck 2×2 rib knitted thermal fabric disclosed in Morgan U.S. Pat. No. 2,839,909. The insulating fabric of this invention used in those tests, was knit and finished in accordance with FIGS. 1–3 of the drawing. The yarns were DuPont's Orlon 44 acrylic yarn and Eastman's Kodel polyester/cotton yarn previously specified, and the fabric weighed approximately 7 ounces per square yard. The comparison thermal fabric used in the tests was knit entirely of 12/1 cotton yarn on a 12 cut machine, and weighed approximately 9 ounces per square yard.

Both the Eastman and Philadelphia College laboratory tests were conducted in accordance with ASTM Test D1518, which is the standard test method for determining the thermal transmittance of textile materials. In conducting that test, and interpreting the results, the following definitions are especially relevant:

$U_1$—combined thermal transmittance of the test fabric and air $U_2$—thermal transmittance of fabric only clo—unit of thermal resistance defined as the insulation required to keep a resting man comfortable in an environment at 21° C., air movement of 0.1 m/s, or roughly the insulation value of typical indoor clothing R—The intrinsic thermal resistance of the fabric alone.

It is important to observe, in testing and evaluating textile fabrics for their heat insulating or thermal value, that the lower the values or coefficients $U_1$ and $U_2$ are, the better. And the higher the values clo and R are, the better.

The results of the Eastman and Philadelphia College fabric tests are set forth in the tables which follow. In examining the data, one must be cautioned, as explained in ASTM D1518, that the thermal testing of fabrics is an extremely complicated subject which involves many factors, so that measured thermal transmittance coefficients necessarily are only indicative of the relative merits of particular fabrics. Further, it must be remembered that the knitting of fabrics is, at best, an inexact science. Many uncontrolled and uncontrollable factors come into play, such as the usual variables in yarn processing, knitting machine operation, fabric finishing, laundering, etc. Accordingly, the test data reproduced below must be evaluated less in absolute terms than in relative or indicative results.

In the tables of data set forth below, Fabric A is the insulating fabric of the invention depicted in FIGS. 1–6, and Fabric B is the comparison Morgan patented thermal fabric described above. Test No. 1 was conducted by Eastman, and Test No. 2 by Philadelphia College.

| TEST NO. 1 (Eastman) | Number of Machine Washings | | |
|---|---|---|---|
| | 0 | 5 | 10 |
| Fabric A | | | |
| $U_1$ | 0.9925 | 0.8838 | 0.8692 |
| $U_2$ | 2.514 | 1.917 | 1.849 |
| clo | 0.4523 | 0.5932 | 0.6149 |
| R | 0.3978 | 0.5217 | 0.5408 |
| Fabric Thickness | 0.095" | 0.132" | 0.142" |
| Fabric Weight (oz/sq. yd.) | 6.970 | 8.130 | 7.890 |
| Fabric B | | | |
| $U_1$ | 1.017 | 0.9802 | 0.9916 |
| $U_2$ | 2.676 | 2.436 | 2.508 |
| clo | 0.4249 | 0.4667 | 0.4534 |
| R | 0.3737 | 0.4104 | 0.3987 |
| Fabric Thickness | 0.120" | 0.146" | 0.144" |
| Fabric Weight (oz/sq. yd.) | 9.200 | 11.150 | 10.860 |

Figure 4:
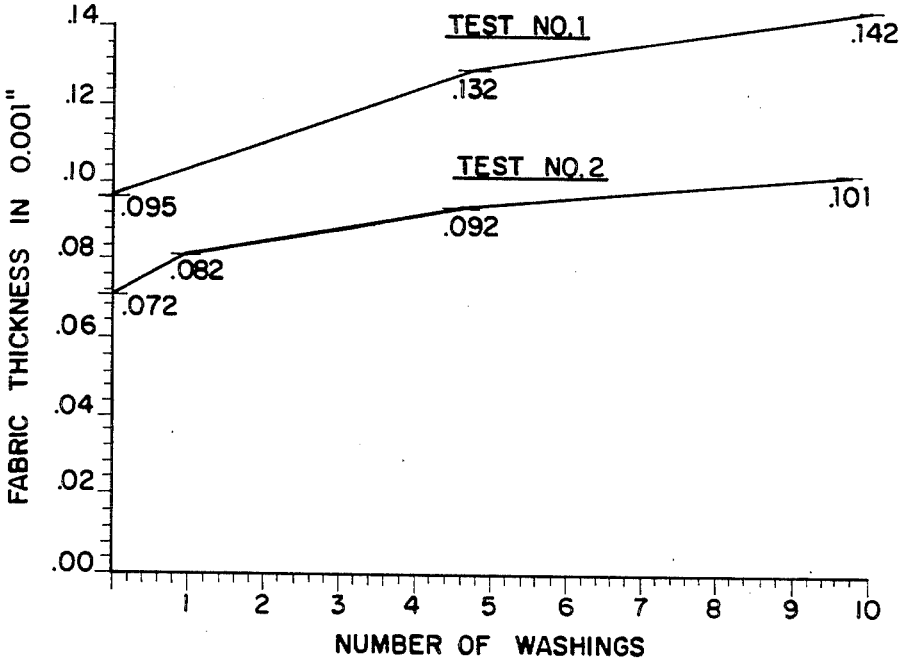
FIG. 4 is a graph depicting the characteristic of the insulating fabric of the invention of first increasing and then stabilizing in thickness as a result of repeated washings, thereby adding bulk and warmth to the fabric.

As the above data reveal, after 10 machine washings the insulating fabric of the invention had increased in thickness approximately 49%. Its thermal resistance had increased approximately 36%. Although the thickness of the comparison thermal fabric had increased approximately 20%, its thermal resistance had increased only 7%;

In FIG. 4, the upper curve, denoted "Test No. 1", illustrates empirically the approximate growth in thickness of the insulating fabric of the invention according to the Eastman test data.

| TEST NO. 2 (Philadelphia College) | Number of Machine Washings | | | |
|---|---|---|---|---|
| | 0 | 1 | 5 | 10 |
| Fabric A | | | | |
| U | 21.925 | 14.391 | 14.179 | 17.659 |
| clo | 0.295 | 0.449 | 0.456 | 0.366 |
| R | 0.046 | 0.069 | 0.071 | 0.057 |
| Fabric Thickness | 0.072" | 0.082" | 0.092" | 0.101" |
| Fabric Weight (oz/sq. yd.) | 6.770 | 7.970 | 7.710 | 7.350 |
| Fabric B | | | | |
| U | 24.581 | 25.029 | 19.257 | 26.810 |
| clo | 0.263 | 0.258 | 0.336 | 0.241 |
| R | 0.041 | 0.040 | 0.052 | 0.037 |
| Fabric Thickness | 0.091" | 0.111" | 0.116" | 0.072" |

-continued

| TEST NO. 2 (Philadelphia College) | Number of Machine Washings | | | |
|---|---|---|---|---|
| | 0 | 1 | 5 | 10 |
| Fabric Weight (oz/sq. yd.) | 8.910 | 10.680 | 11.360 | 10.310 |

According to the above data from the Philadelphia College laboratory test, after 5 machine washings the insulating fabric of the invention had increased in thickness by approximately 28%, and its thermal resistance had increased approximately 54%. After 5 machine washings, the thickness of the comparison thermal fabric had increased 27%, but its increase in thermal resistance was only 27%.

After 10 washings, both test fabrics exhibited a decline in thermal resistance, but the decline in the comparison fabric was greater than that in the fabric of the invention. After 10 washings, the thickness of the comparison fabric had reduced drastically, whereas the thickness of the fabric of the invention continued to increase.

In FIG. 4, the lower curve, denoted "Test No. 2", illustrates empirically the approximate growth in thickness of the insulating fabric of the invention according to the Philadelphia College test data.

Notwithstanding the comparison fabrics in the two above tests were more than 2 ounces per square yard heavier than the insulating fabrics of the invention, the test data confirmed the superior thermal or heat retention properties of the fabric of the invention.

As indicated previously, the insulating fabric of this invention may include as its base fabric any knitted thermal fabric incorporating air-entrapping cells. A highly satisfactory insulating fabric embodying this invention may be made utilizing as its base fabric the triple tuck 2×2 rib knitted thermal fabric disclosed in Morgan U.S. Pat. No. 2,839,909 aforesaid. FIG. 7 of the drawing depicts the knitting diagram for that fabric, illustrating both the method used in knitting the fabric as well as its stitch structure.

In FIG. 7, the horizontal letters D, D, C, C, D, etc. denote individual needles mounted 2×2 on the dial and on the cylinder, respectively, of the knitting machine when FIG. 7 is read as the method of knitting. Those letters also depict the 2×2 alternating dial and cylinder needle wales in the knitted fabric. The vertical left-hand column of numbers 1, 2, 3, etc. identifies consecutive yarn feeds of the circular knitting machine used, and also depicts the fabric courses knitted at those yarn feeds. The letters T and K indicate, respectively, in the knitting process, whether the cylinder and dial needles tuck or knit. Those letters also identify, respectively, the tuck loops and knitted stitches in the fabric.

The knitting diagram of FIG. 7 illustrates one complete 8 course cycle of knitting, which is repeated successively on the knitting machine to produce thermal fabric having air-entrapping cells on both sides.

In utilizing that thermal fabric as the base fabric for this invention, a high bulk 100% acrylic yarn is fed to the needles of the knitting machine at yarn feeds 4, 5, 6, 7, while the polyester/cotton yarn is fed to the needles at yarn feeds 1, 2, 3 and 8. In such arrangement, at yarn feeds 1, 2 and 3 the polyester/cotton yarn is tucked on the dial needles and knitted on the cylinder needles. At yarn feed 4, where the high bulk acrylic yarn is fed, all needles knit, thus casting the triple tucks of poly/cotton yarn off of the dial needles.

At yarn feeds 5, 6, 7, the acrylic yarn is tucked by the cylinder needles and knitted by the dial needles. At yarn feed 8, where the polyester/cotton yarn is fed, all needles knit so that the triple tucks of acrylic yarn on the cylinder needles are cast off. As a result, the high bulk acrylic yarn appears on the inside face of the tubular fabric. The combined polyester and cotton yarn appears on the outside face of the fabric, and provides the necessary knitted frame or framework for anchoring and stabilizing the acrylic yarn.

Insulating fabric in accordance with FIG. 7 was knit on an 8 feed, 12 cut circular rib knitting machine. The yarns used were DuPont's 22/1 (worsted count) Orlon 44 high bulk acrylic yarn and Eastman's 18/1 Kodel 50/50 polyester/cotton yarn. The fabric, when removed from the knitting machine, weighed approximately 7.5 ounces per square yard. Normally, commercial triple tuck thermal fabric made in accordance with Morgan U.S. Pat. No. 2,839,909 weighs approximately 9 ounces per square yard.

The insulating fabric, knit in accordance with the specifications described above, was subjected to a series of 10 machine washings as a result of which the fabric added bulk and increased in thickness by 0.046", or approximately 33⅓%. The original fabric thickness, prior to the first washing was 0.138". Its thickness after the tenth washing was 0.184". Set forth below is a table illustrating the thickness of the fabric following each of the ten machine washings to which it was subjected:

| Number of Machine Washings | Fabric Thickness After Each Washing |
|---|---|
| original (unwashed) | .138" |
| 1st washing | .166" |
| 2nd washing | .170" |
| 3rd washing | .172" |
| 4th washing | .179" |
| 5th washing | .179" |
| 6th washing | .184" |
| 7th washing | .176" |
| 8th washing | .188" |
| 9th washing | .166" |
| 10th washing | .184" |

It will be observed, from the foregoing table, that the knitted fabric continued to increase in thickness through the first six machine washings, following which the thickness of the fabric tended to stabilize. As a result of the several washings, and the concomitant increase in thickness, due to increased bulk or loft, the fabric enhanced its air-entrapping capacity, acquired a greater heat retention quality and thus became a warmer fabric then it was before it was washed.

Although preferred embodiments of this invention have been shown and described for the purpose of illustration, as required by Title 35 U.S.C. §112, it is to be understood that various changes and modifications may be made therein without departing from the spirit and utility of this invention, or the scope thereof as set forth in the appended claims.

For example, yarns equivalent to the high bulk acrylic and blended polyester/cotton yarns described above could be used in the successful practice of this invention. The high bulk yarn may be other than acrylic, but alternate bulk yarns should provide properties of low absorbency, warmth, resilience and comfort comparable to high bulk acrylic yarn, as well as the capacity to be napped. The non-bulk yarn preferably should be composed partly of cotton, because of its inherent good hand and absorbency. While polyester is the preferred fiber to be blended with cotton in the non-bulk yarn, other synthetic fibers could be used in lieu thereof, provided the combination synthetic/cotton yarn provides the necessary characteristics of absorbency, quick drying, good hand and strength. The synthetic/cotton yarn selected must function to provide a relatively rigid knitted framework for anchoring and stabilizing the bulk yarn in the fabric.

I claim:

1. An insulating fabric having an inner fabric face of soft texture formed of a high bulk yarn and an outer fabric face formed of a combined synthetic and cotton yarn, said insulating fabric being characterized by an increase in thickness as the result of plural washings to enhance its heat insulating quality and comprising (a) a base fabric constituted of a knitted thermal fabric having air-entrapping cells, (b) said base fabric being knitted of a napped high bulk yarn in selected courses and being knitted of a combined synthetic and cotton yarn in courses intervening between the selected courses.

(c) the combined synthetic and cotton yarns forming a knitted framework for anchoring and stabilizing the high bulk yarn in the fabric.

2. The insulating fabric of claim 1, wherein the high bulk yarn is acrylic yarn and the combined synthetic and cotton yarn is a polyester/cotton yarn.

3. An insulating fabric having an inner side and an outer side comprising (a) a base fabric constituted of a knitted thermal fabric having air-entrapping cells, (b) said base fabric being knitted of a high bulk acrylic yarn in selected courses and being knitted of a combined polyester and cotton yarn in courses intervening between the selected courses, said acrylic yarn being napped, (c) the acrylic yarn being disposed on the inner side of the fabric and the combined polyester and cotton yarn being disposed on the outer side of the fabric.

4. The insulating fabric of claim 3, wherein the combined polyester and cotton yarn provides a knitted framework for anchoring and stabilizing the high bulk acrylic yarn in the fabric.

5. A method of making an insulating fabric having an inner fabric face of soft texture formed of a high bulk yarn and an outer fabric face formed of a combined synthetic and cotton yarn comprising knitting a base thermal fabric having air-entrapping cells and, during knitting, (a) forming selected courses of the base fabric of a high bulk yarn and forming courses intervening between the selected courses of a combined synthetic and cotton yarn and (b) feeding the yarns selectively to place the high bulk yarn on the inner fabric face and to provide a knitted framework composed of the synthetic and cotton yarn on the outer fabric face for anchoring and stabilizing the high bulk yarn in the fabric, and then napping the high bulk yarn following knitting of the base thermal fabric.

6. The method of making the insulating fabric of claim 5, further including the step of subjecting the fabric to plural washings to increase its thickness and enhance its heat insulating quality.

7. The method of making the insulating fabric of claim 5, further including the step of increasing the heat insulating quality of the fabric by at least 25% by subjecting the fabric to plural washings to increase its thickness.

8. The method of making the insulating fabric of claim 5, further including the step of increasing the thickness of the fabric to enhance its heat retention quality by subjecting the fabric to a plurality of washings.

9. The method of making the insulating fabric of claim 5, further including the step of subjecting the fabric to a plurality of washings to increase its thickness by at least $33\frac{1}{3}\%$ to enhance its heat retention quality.

10. The method of making the insulating fabric of claim 5, further including the steps of (a) forming the selected courses of a high bulk acrylic yarn and (b) forming the intervening courses of a combined polyester/cotton yarn.

* * * * *